US009694949B2

(12) United States Patent
Hendricks et al.

(10) Patent No.: US 9,694,949 B2
(45) Date of Patent: Jul. 4, 2017

(54) AIRTIGHT CONTAINER

(71) Applicant: THE HERSHEY COMPANY, Hershey, PA (US)

(72) Inventors: William J. Hendricks, Elizabethtown, PA (US); Jonathon K. Markey, Greensboro, NC (US); Eric Lawrence, Hershey, PA (US); Michael J. Van Driest, Asheboro, NC (US)

(73) Assignee: The Hershey Company, Hershey, PA (US)

( * ) Notice: Subject to any disclaimer, the term of this patent is extended or adjusted under 35 U.S.C. 154(b) by 0 days.

(21) Appl. No.: 14/780,030

(22) PCT Filed: Mar. 27, 2014

(86) PCT No.: PCT/US2014/031997
§ 371 (c)(1),
(2) Date: Sep. 25, 2015

(87) PCT Pub. No.: WO2014/160852
PCT Pub. Date: Oct. 2, 2014

(65) Prior Publication Data

US 2016/0052681 A1 Feb. 25, 2016

Related U.S. Application Data

(60) Provisional application No. 61/805,964, filed on Mar. 28, 2013.

(51) Int. Cl.
*B65D 43/16* (2006.01)
*B65D 43/02* (2006.01)
(Continued)

(52) U.S. Cl.
CPC ..... *B65D 43/16* (2013.01); *B65D 43/0212* (2013.01); *B65D 47/0847* (2013.01);
(Continued)

(58) Field of Classification Search
CPC ..... B65D 43/169; B65D 43/163; B65D 43/16
(Continued)

(56) References Cited

U.S. PATENT DOCUMENTS 3,307,602 A * 3/1967 Boster ..... B65D 43/0212 206/508
2002/0017522 A1* 2/2002 Bando ..... B65D 43/16 220/254.3

(Continued)

FOREIGN PATENT DOCUMENTS

JP 2005304572 A 11/2005
JP 2007314233 A 12/2007

(Continued)

*Primary Examiner* — King M Chu
(74) *Attorney, Agent, or Firm* — McNees Wallace & Nurick LLC

(57) ABSTRACT

An airtight container for storing comestibles and other articles is disclosed that includes a bottom container portion having a bottom seal section, a top container portion having a top seal section, the top seal section engaged with the bottom seal section to form a container seal at a circular interface, an opening in the top portion, the opening recessed from an outer surface of the top portion and a lid door movably secured to the top portion in which the lid door is configured to selectively engage the opening to form an access seal and in which the top container portion is configured to promote laminar flow across the top portion outer surface.

18 Claims, 7 Drawing Sheets

(51) Int. Cl.
*B65D 47/08* (2006.01)
*B65D 47/32* (2006.01)

(52) U.S. Cl.
CPC ..... *B65D 47/0852* (2013.01); *B65D 47/32* (2013.01); *B65D 2543/0074* (2013.01); *B65D 2543/00092* (2013.01); *B65D 2543/00296* (2013.01); *B65D 2543/00518* (2013.01); *B65D 2543/00537* (2013.01); *B65D 2543/00555* (2013.01); *B65D 2543/00629* (2013.01); *B65D 2543/00685* (2013.01); *B65D 2543/00796* (2013.01)

(58) Field of Classification Search
USPC ..... 220/254.3, 254.1, 254.7, 791, 789, 780
See application file for complete search history.

(56) References Cited

U.S. PATENT DOCUMENTS

| | | | | |
|---|---|---|---|---|
| 2006/0091098 | A1* | 5/2006 | Thilly | A61J 1/1412 215/249 |
| 2007/0164027 | A1* | 7/2007 | Auer | B65D 41/185 220/254.3 |
| 2009/0101654 | A1 | 4/2009 | Brashear | |

FOREIGN PATENT DOCUMENTS

| | | | |
|---|---|---|---|
| JP | 2009083902 | A | 4/2009 |
| WO | 98/19933 | A1 | 5/1998 |

* cited by examiner

AIRTIGHT CONTAINER

CROSS-REFERENCE TO RELATED APPLICATION

This application claims the benefit of and priority to U.S. Provisional Patent Application No. 61/805,964 entitled "Airtight Container" filed on Mar. 28, 2013, which is hereby incorporated by reference in its entirety.

FIELD OF THE INVENTION

The present application is directed toward the field of containers and more particularly to airtight containers.

BACKGROUND OF THE INVENTION

A variety of containers are available for housing and transporting comestibles such as mints, candies or gum. The focus of many containers is to prevent contaminants from entering the container, or to provide an article for conveniently transporting and/or storing comestibles. Many of the containers include an opening for dispensing an item housed within the container. Often, the opening in the container is closeable through a lid or a flap.

As the lid or flap is opened to dispense the items housed in the container, ambient air may enter the container through the opening. Additionally, many containers are not airtight, allowing ambient air to enter an interior portion of the container even when the lid or flap is closed. The ambient air can affect the freshness, appearance, and/or consistency of the comestible stored within the container.

What is needed is a container that is airtight, reduces ambient air flow into the container when opened, improves shipability, reduces spoiling of products by mitigating overall exposure to ambient air, and has a tighter closure for maintaining a closed position.

BRIEF DESCRIPTION OF THE INVENTION

Exemplary embodiments are directed to airtight containers useful for storing comestibles and other articles to protect them from the ingress of moisture in high humidity environments.

In one embodiment, an airtight container comprises a bottom container portion having a bottom seal section and a top container portion having a top seal section. The top seal section is engaged with the bottom seal section to form a container seal at a circular interface. The container further includes an opening in the top portion, the opening recessed from an outer surface of the top portion and a lid door movably secured to the top portion. The lid door is configured to selectively engage the opening to form an access seal and the top container portion is configured to promote laminar flow across the top portion outer surface.

In another embodiment, an airtight container comprises a bottom container portion having a bottom seal section and a top container portion having a top seal section, the top seal section engaged with the bottom seal section to form a permanent airtight double container seal at a circular interface. The container also includes a circular or ellipitcal opening in the top portion, the opening recessed from an outer surface of the top portion and a lid door movably secured to the top portion. The lid door is configured to selectively engage the opening to form an access seal and further configured to be disengaged from the opening upon a force in the range of 3 to 5 pounds per square inch. The top container portion is configured with airfoil radiusing to promote laminar flow across the top portion outer surface and the container has a diameter of about three inches or less.

An advantage of exemplary embodiments is that an ingress of ambient air into the airtight container is reduced or eliminated.

Another advantage of exemplary embodiments is the ability to open the lid and dispense comestibles from within the airtight container without introducing ambient air into the airtight container.

Yet another advantage of exemplary embodiments is an increased storage life of the comestibles within the airtight container.

Still another advantage of exemplary embodiments is a reduction or elimination of color bleed in the comestibles within the airtight container.

Another advantage of exemplary embodiments is an ability to repeatedly open and close the lid without compromising the airtight seal between the lid and the opening.

Yet another advantage of exemplary embodiment is the ability of the airtight container to experience variations in pressure without venting.

Other features and advantages of the present invention will be apparent from the following more detailed description, taken in conjunction with the accompanying drawings which illustrate, by way of example, the principles of the invention.

Exemplary embodiments are directed to containers that meet these needs.

BRIEF DESCRIPTION OF THE DRAWINGS

Wherever possible, the same reference numbers will be used throughout the drawings to represent the same parts.

DETAILED DESCRIPTION OF THE INVENTION

Referring to FIGS. 1-12, in one embodiment, an airtight container 100 includes a bottom portion 101, a top portion 102, and a detachable lid door 103 (FIGS. 1-2), in which the top portion 102 and detachable lid door 103 together form the container lid. The top portion 102 is secured to the bottom portion 101, while the detachable lid door 103 is movably supported by the top portion 102. While shown and described primarily with respect to embodiments that are puck shaped (i.e., in which the container diameter is larger than the container height), the invention is not so limited and any size container may be employed.

Figure 2:
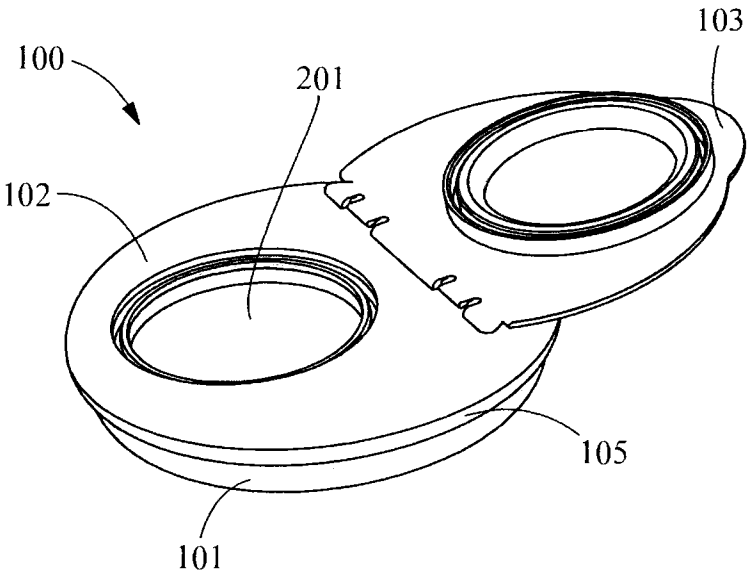
FIG. 2 illustrates a perspective view of the airtight container of FIG. 1 having a detachable lid open.
Figure 1:
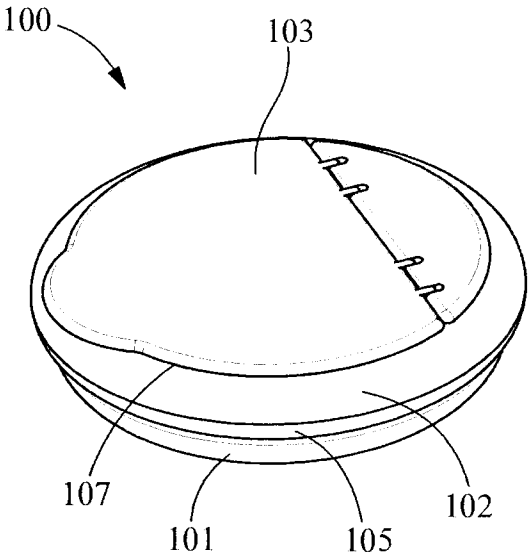
FIG. 1 illustrates a perspective view of an airtight container according to an embodiment of the disclosure.
Figure 3:
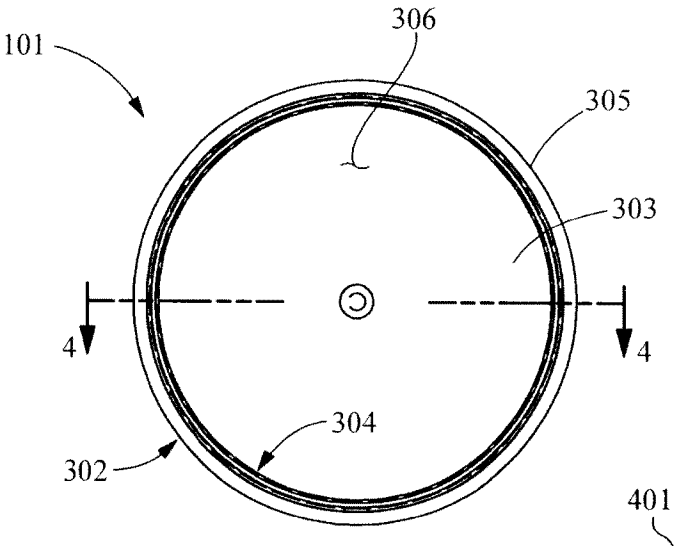
FIG. 3 illustrates a top view of a bottom portion of the airtight container.
Figure 5:
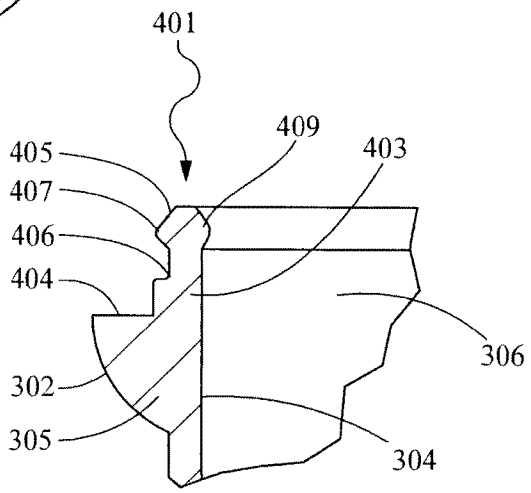
FIG. 5 illustrates an enhanced view of the bottom seal section of FIG. 4.
Figure 4:
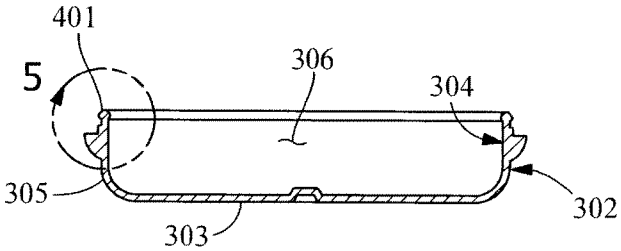
FIG. 4 illustrates a side sectional view of the bottom portion of the airtight container.
Figure 7:
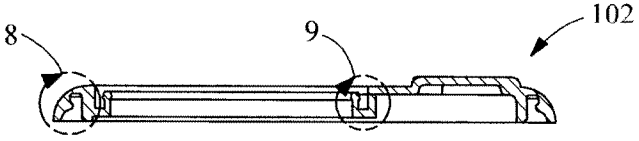
FIG. 7 illustrates a side sectional view of the top portion of the airtight container shown in FIG. 6.
Figure 14:
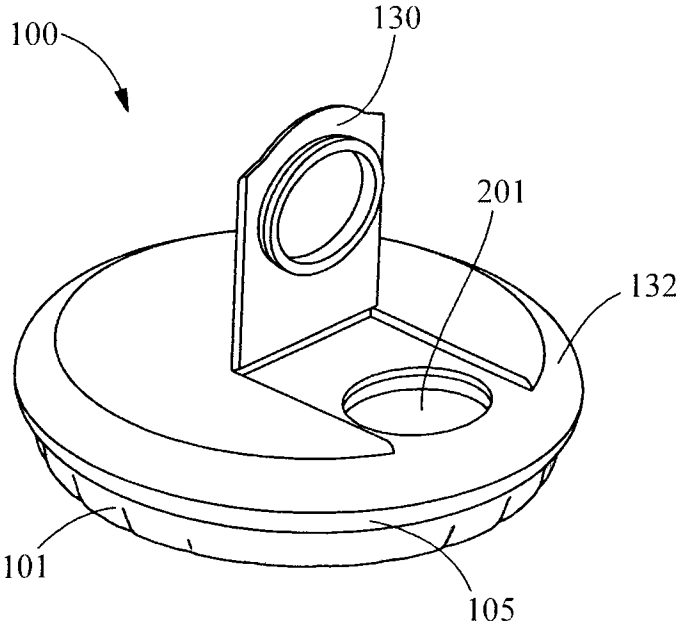
FIG. 14 illustrates a perspective view of the airtight container of FIG. 13 having an integral lid door opened.
Figure 13:
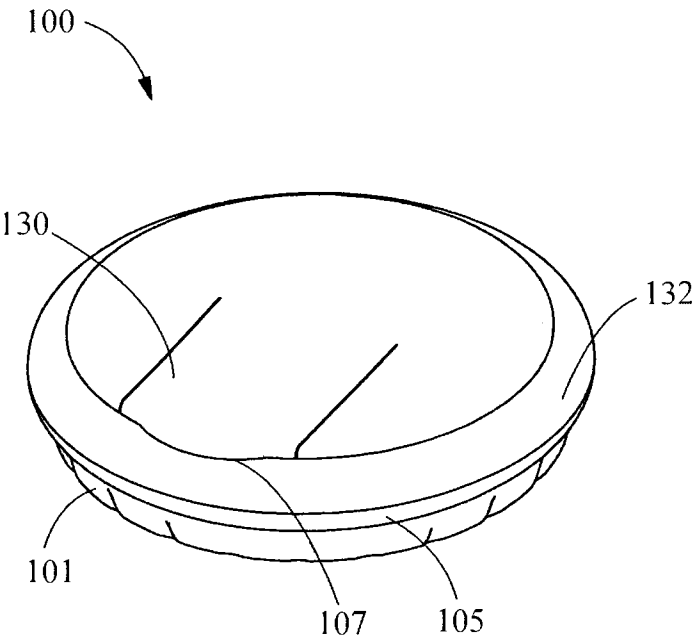
FIG. 13 illustrates a perspective view of an airtight container according to another embodiment of the disclosure.

As best seen in FIGS. 3-5, in one embodiment, the bottom portion 101 includes a cylindrical disc having a bottom face 303 and a bottom side wall 305. The bottom face 303 and the bottom side wall 305 together form a first outer surface 302 and a first inner surface 304 of the container 100. The first outer surface 302 provides an exterior of the bottom portion 101, and the first inner surface 304 defines a cavity 306. Opposite the bottom face 303 is an opening in the bottom portion 101 to provide access to the cavity 306. In one embodiment, as best seen in FIGS. 13-14, the bottom portion 101 includes scalloped features to facilitate gripping of the airtight container 100. The bottom face 303 and bottom side wall 305 may be of any geometry, although the geometry of the interface of the bottom portion 101 and top portion 102 of the container should be circular to ensure a properly sealed edge.

The bottom side wall 305 includes a bottom seal section 401 formed distally from the bottom face 303. For example, in one embodiment, as best seen in FIG. 5, the bottom seal section 401 includes a male portion 403, a ledge 404, and a step 406. The male portion 403 includes an engagement member 405 having an external protrusion 407 extending from the first outer surface 302, and an internal protrusion 409 extending from the first inner surface 304. The external protrusion 407 and/or the internal protrusion 409 include any suitable shape, such as, but not limited to, circular, semi-circular, triangular, polygonal, or a combination thereof. For example, in one embodiment, the external protrusion 407 includes a substantially triangular protrusion, and the internal protrusion 409 includes a semi-circular protrusion.

Referring to FIGS. 6-9, in one embodiment, the top portion 102 is a circular or semi-circular disc having a top face 603 and a top side wall 605. The top face 603 is curved at an outer perimeter of the top portion 102 to form the top side wall 605, the curvature made in the form of airfoil radiusing to promote laminar flow across the top portion of the container 100 as described subsequently in more detail. Together, the top face 603 and the top side wall 605 form a second outer surface 602 and a second inner surface 604.

Figure 8:
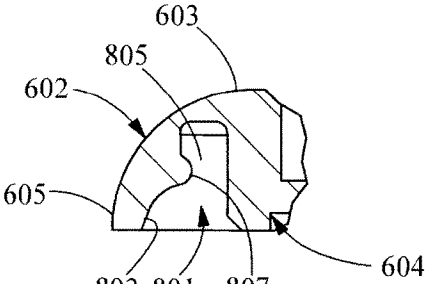
FIG. 8 illustrates an enhanced view of a top seal section of the top portion.

The top side wall 605 includes a top seal section 801 formed opposite the top face 603. The top seal section 801 is complementary to the bottom seal section 401 to form a compression fit between the top portion 102 and the bottom portion 101. For example, in one embodiment, as best seen in FIG. 8, the top seal section 801 includes a female portion 803 complementary to the male portion 403 of the bottom seal section 401. Alternatively, the top seal section 801 may include the male portion 403, and the bottom seal section 401 may include the female portion 803. The female portion 803 includes any suitable shape for receiving and securing the male portion 403 therein. For example, in another embodiment, the female portion 803 includes a receiving slot 805 and a retaining feature 807. The receiving slot 805 receives the engagement member 405 therein, the respective geometries resulting in a double-seal between the male portion 403 and the female portion 803.

The double-seal resulting from the interlocking of the male portion 403 and the female portion 803 of the container forms a container seal 105 and has the advantage of being able to accomplish an airtight container seal. As used herein, "airtight" refers to a seal that does not permit passage of air therethrough when closed. In one embodiment, when the engagement member 405 is inserted within the receiving slot 805 the retaining feature 807 is positioned between the step 406 and the external protrusion 407. The retaining feature 807 both maintains the engagement member 405 within the receiving slot 805 and forms a portion of the double-seal through contact with the step 406, the male portion 403, and/or the external protrusion 407. The internal protrusion 409 contacts the receiving slot 805 proximal to the second inner surface 604 to form a portion of the double-seal and urge the external protrusion 407 into contact with the receiving slot 805 and the retaining feature 807.

When the top portion 102 is secured to the bottom portion 101, the first inner surface 304 and the second inner surface 604 define an interior space 201 (FIG. 2) of the container 100 that can be used for storing comestibles or other articles. The first outer surface 302 and the second outer surface 602 cooperate together to form an exterior of the container 100. In one embodiment, the top portion 102 is secured to the bottom portion 101 during manufacture to achieve the airtight container seal. The top portion 102 may be permanently secured, advantageously by a friction fit between the male and female portions 403, 805, to the bottom portion 101 such that those portions cannot be subsequently separated from one another without breaking the container 100. Alternatively, while not intended to be used for accessing the interior space 201 after initial manufacture, the top portion 102 may be detachably secured to the bottom portion 101 in a manner that provides the airtight container seal 105 while permitting separation with a force less than that which would cause the container 100 to break.

Figure 9:
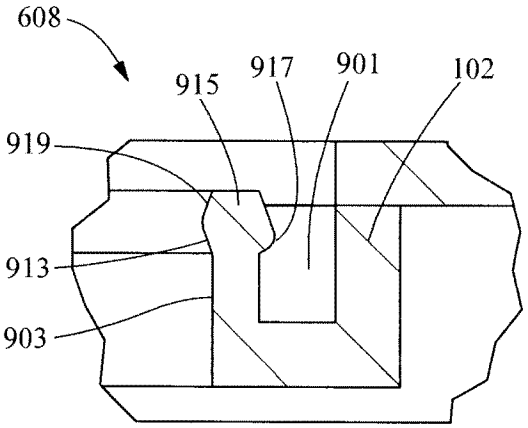
FIG. 9 illustrates an enhanced view of an access seal section of the top portion.
Figure 6:
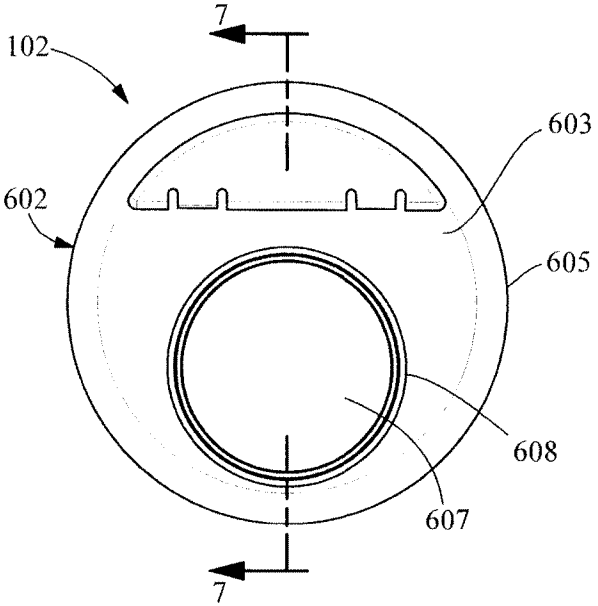
FIG. 6 illustrates a top view of a top portion of the airtight container according to an embodiment of the disclosure without the lid door attached.

To facilitate dispensing of items, such as comestibles, from within the interior space 201, the top portion 102 includes an opening 607 (FIG. 6) that is selectively closable. The comestibles include, for example, hard candies, mints, or any other edible item that may be affected by exposure to moisture. In one embodiment, the opening 607 is circular, surrounded by an access seal section 608. Referring to FIG. 9, the access seal section 608 includes a channel 901 defined by the top portion 102 and an inner wall 903. In another embodiment, the inner wall 903 includes a male portion 913 with an engagement member 915 in a manner similar to that described with respect to the mating of the top portion 102 with the bottom portion 101. The external protrusion 917 of the engagement member 915 extends towards the top portion 102, while the internal protrusion 915 extends towards the opening 607.

Figure 11:
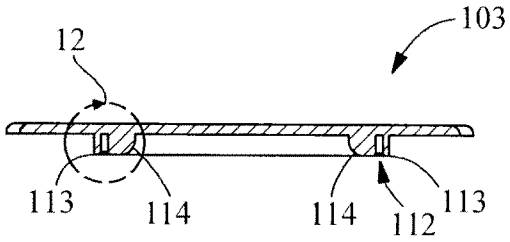
FIG. 11 illustrates a side sectional section view of the lid door of FIG. 10.
Figure 10:
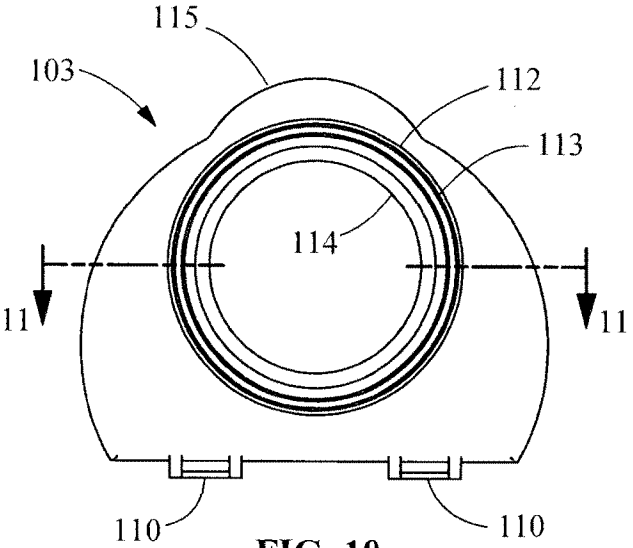
FIG. 10 illustrates a bottom view of a lid door according to an embodiment of the disclosure.
Figure 12:
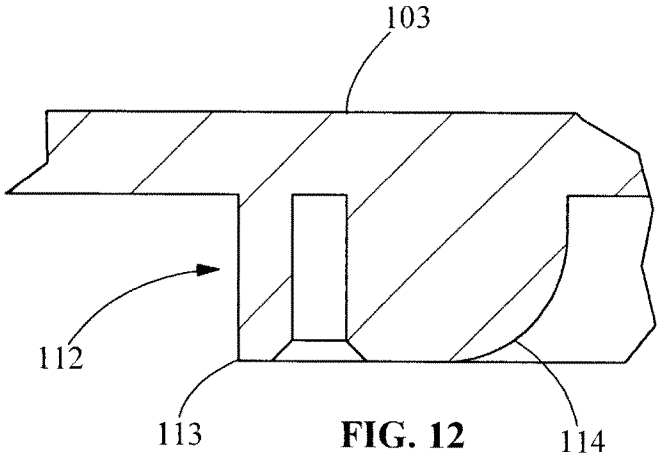
FIG. 12 illustrates an enhanced view of a lid seal section of the lid door.

Referring to FIGS. 10-12, in one embodiment, the detachable lid door 103 is detachably and movably secured to the top portion 102 by a plurality of external hinge members 110. The detachable lid door 103 includes a lid seal section 112 that engages the access seal section 608 to form an airtight access seal 107 when the detachable lid door 103 is closed, again with a geometry analogous to that described with respect to the attachment of the base portion 101 to the lid portion 102. As best seen in FIG. 12, the lid seal section 112 includes two concentric, circular protrusions. In one embodiment, the protrusions include a channel member 113 and an opening member 114. When the detachable lid door 103 is closed, the opening member 114 engages the internal protrusion 919, and the channel member 113 engages the external protrusion 917 and the top portion 102 adjacent the channel 901. Together, the opening member 114 and the channel member 113 form a re-closable, double-seal that provides the airtight access seal 107.

Figure 15:
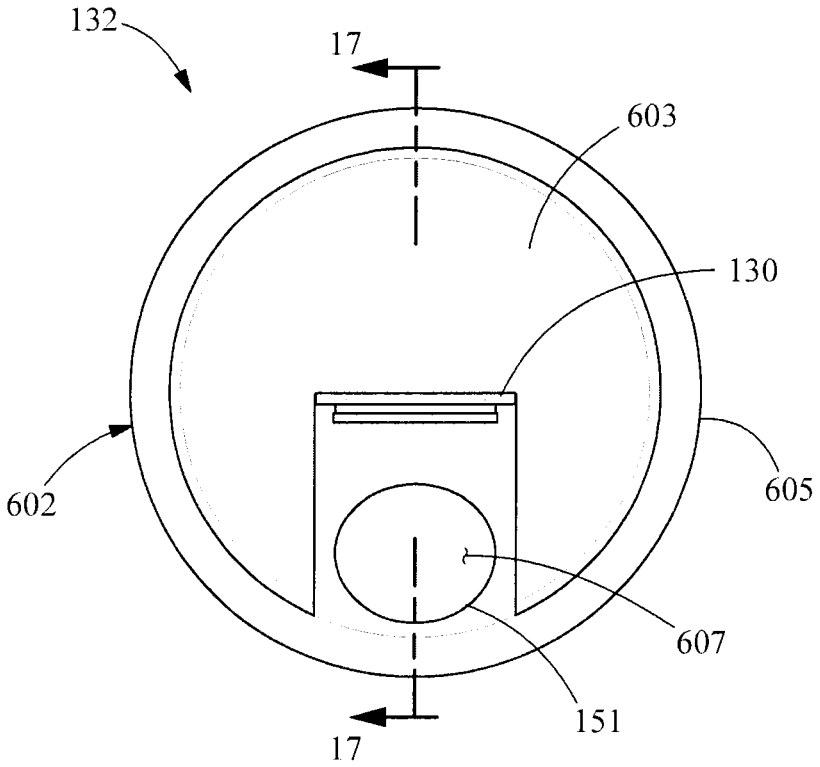
FIG. 15 illustrates a top view of the top portion of the airtight container according to an embodiment of the disclosure.
Figure 16:
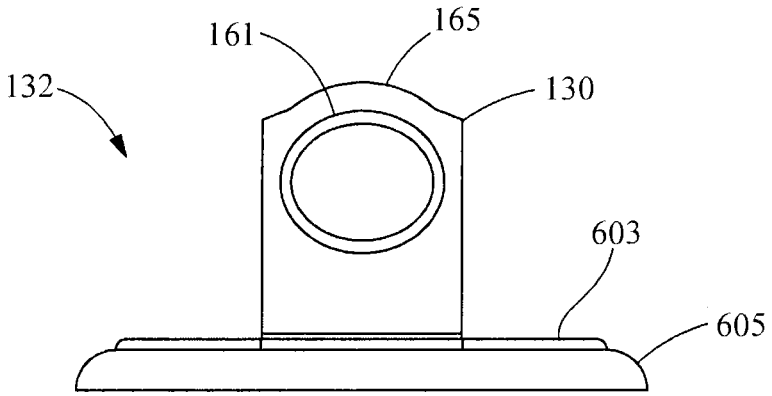
FIG. 16 illustrates a front view of the top portion.
Figure 17:
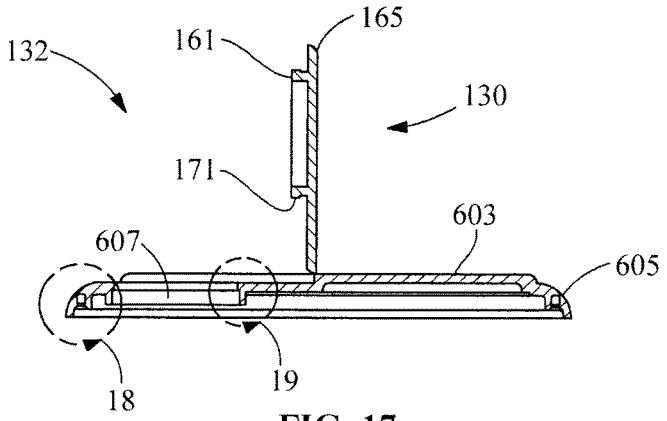
FIG. 17 illustrates a side sectional view of the top portion of FIG. 16.
Figure 18:
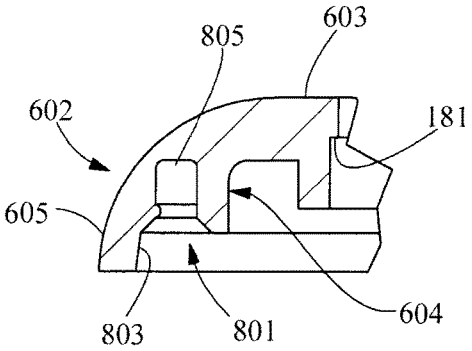
FIG. 18 illustrates an enhanced view of the top portion mating with the bottom portion.
Figure 19:
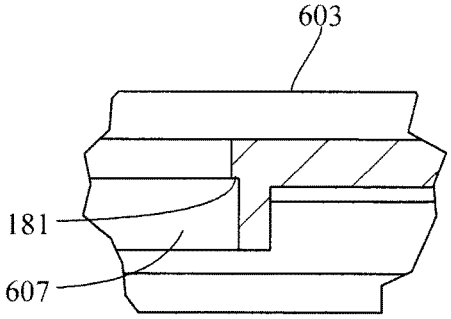
FIG. 19 illustrates an enhanced view of the integral lid door mating with the top portion.

Referring to FIGS. 13-19, in an alternate embodiment, the container lid is provided as a top portion 132 that includes an integral lid door 130 movably secured thereto. Referring to FIG. 18, the top portion 132 includes the top seal section 801, which is secured to the bottom seal section 401 of the bottom portion 101, as previously disclosed with respect to the top portion 102. As depicted in FIGS. 14-15, the opening 607 in the top portion 132 includes an elliptical or oval shape to facilitate dispensing of items. While circular openings are generally preferred, oval openings also work to provide excellent results with respect to airflow, although the diameter of the opening 607 for an ovular geometry may need to be smaller to achieve the same level of results compared to a circular opening.

Referring to FIGS. 15-19, the opening 607 in the top portion 132 includes a rim 151, and the integral lid 130 includes a corresponding projection 161. When closed, a lip portion 171 of the projection 161 engages a ledge 181 of the rim 151 to form a friction fit seal that provides the airtight access seal 107. As with the top portion 102 of the detachable lid door embodiment, the top portion 132 of the integral lid door embodiment may be permanently or detachably secured to the bottom portion 101. In one embodiment, the top portion 102 is interchangeable with the top portion 132 with respect to the bottom portion 101.

The airtight containers 100 thus described herein form a hand-to-mouth container ideally suited for comestibles, although there is no limit on the containers' contents.

In one embodiment, the airtight container 100 includes a diameter of up to about 5 inches, up to about 3 inches, or any other suitable diameter for housing comestibles therein. In another embodiment, the opening 607 includes a diameter of up to about 2.5 inches, about 1.5 inches, about 1 inch, or any other suitable diameter for dispensing comestibles therethrough. For example, in one embodiment, the diameter of the airtight container is about 2.90 inches and the diameter of the opening 607 is about 1.50 inches, more than half the diameter of the airtight container 100. As the diameter of the opening 607 is increased relative to the diameter of the airtight container 100, it is increasingly difficult to reduce the ingress of ambient air when the container 100 is opened to remove one or more comestibles, although exemplary embodiments have demonstrated the ability to remain resist to that ingress, even when the lid door is opened.

Regardless of whether a detachable lid door 103 or an integral lid door 130 is employed, the approach angle of the lid door is such that during closing, the projection extending from the lid door engages the corresponding seal section at the opening 607 in a substantially vertical manner. This results in the opening 607 being closed over its entire area, rather than gradually along its diameter when the lid door is lowered. To facilitate opening of the airtight container 100, the lid door 103, 130 includes a peak 115, 165. The peak provides a point of access for the application of force by a consumer attempting to open the lid. For example, in one embodiment, the lid door is opened with a force of not less than three and not more than five pounds per square inch applied at the peak.

In addition to the shape and configuration of the seals which keeps air from ingressing into the interior space 201 of the container 100, the shape and configuration of the airtight container 100 further mitigates the transfer of air (including potentially damaging moisture and oxygen) into and out of the container even when the lid door of the container is opened.

Regardless of which top portion 102, 132 is used (and thus whether a detachable or integrated lid door is used), the top portion is shaped to promote laminar flow across the second outer surface 602, rather than a turbulent flow. Turbulent flow is more likely to travel in unpredictable directions, including into the interior of the container. A laminar flow across the second outer surface 602 is promoted by airfoil radiusing of the top portion 102 and the top portion 132. The top portion 102, 132 and the bottom portion 101 are formed such that turbulent airflow at the second outer surface 602 is reduced below a predetermined level. The reduced turbulent airflow increases the laminar air-flow across the second outer surface 602, which flows over the opening 607 even when the container is opened.

The airfoil radius is that of a conical curve. In the embodiments herein shown and described, the airfoil radiusing results in a curvature at the outer surface 602 having a radius of 0.245 inches. For a particular design, the airfoil radius to be employed may be calculated by that of a circle having tangency to two ellipses of the same shape but different orientation such that one ellipse captures the curve where the horizontal surface of the second outer surface 602 transitions to curved, while the other ellipse captures the curve where the second outer surface 602 transitions from curved to vertical.

To further reduce the ingress of ambient air when the container 100 is opened, embodiments position the container opening 607 as being recessed from the second outer surface 602 of the top portion. The subsurface positioning of the opening 607 removes the opening 607 from the laminar flow, reducing or eliminating ingress of ambient air into the airtight container 100 even during opening and closing of the lid door.

As a result, this can also reduce or eliminate the introduction of water vapor contained in the ambient air into the container, meaning that the air within the container may be of a lower humidity than that of the external environment, such as, for example, a hot and/or humid environment. The container may advantageously be used to hold comestibles such as, but not limited to, a sugar product, a confection product, a mint product, a sugar-free mint product, or a combination thereof, any of which may be adversely affected in high humidity environments. The reduction or elimination of humid air within the container further helps to also reduce or eliminate color bleed in comestibles having colored inclusions. The reduction or elimination of color bleed in the comestibles reduces the formation of a messy and/or unappetizing appearance, which in turn increases the storage life of the comestibles within the airtight container 100.

In addition to forming the airtight container 100, the airtight container seal 105 and the airtight access seal 107 form tighter closures, increasing an ability of the airtight container 100 to stay closed. Together, the increased ability to stay closed and the increased storage life of the comestible in the airtight container 100 improve shippability of the comestibles over longer distances and/or times.

In one embodiment, the container includes a molded-in plug-seal (not shown) in the opening 607. The plug-seal includes a pull-ring for easier removal of the plug-seal from the opening 607. The plug-seal further eliminates or substantially eliminates the ingress of ambient air into the container through the opening 607 prior to the plug seal's removal by the consumer the first time some of the product within the container is ready to be consumed. In another embodiment, the container may include an applied, consumer-removable foil seal over the opening 607. The foil seal further eliminates or substantially eliminates the ingress of ambient air into the container, through the opening 607, while the foil seal is in place. The foil seal increases storage life and shippability of the comestibles prior to removal of the foil seal. The use of a plug-seal or a foil seal also provides a level of tamper resistance to the product.

The airtight container 100 and its respective components may be constructed of any suitable material, such as, but not limited to, a thermoplastic or other polymeric material, and may be manufactured by molding, extrusion, or thermoforming by way of example. The specific material selected may depend upon the particular manufacturing method employed, as well as the physical properties of the thermoplastic, including its pliability, such that the formed components can be manufactured at a level of precision that permits the various features of the male and female portions 403, 803 to be consistently and repeatedly produced and may be a blend of one or more resins of similar or different base constituents. Exemplary such materials include high-density polyethylene and polypropylene, by way of example only, including blends and copolymers of these materials. Due to the pliability of the material, the airtight container 100 is able to withstand variations in pressure without venting. For example, in one embodiment, the airtight container 100 expands and/or contracts in response to variations in pressure without any air entering or exiting, thus maintaining the airtight seals until the pressure differential is large enough to cause the airtight container 100 to match the engineered opening force of the lid door (e.g., greater than 3-5 pounds).

EXAMPLES

The invention is further described in the context of the following examples, which are presented by way of illustration, not of limitation.

Example 1

Three containers of different polypropylene resins were constructed as described and shown with respect to the embodiment illustrated in FIGS. 1-12. Container 1 was constructed of a polypropylene homopolymer (Braskem CP350WV), container 2 was constructed of a polypropylene impact copolymer (Braskem TI4700P2), and container 3 was constructed of a second polypropylene homopolymer (Braskem ZS-751). The containers were weighed to determine a tare weight, filled with dehydrated silica gel desiccants and weighed again to determine an initial weight. With the lid door closed, the container was stored under environmentally controlled conditions of 103° F. and 80% relative humidity. After 24 hours, the containers were weighed again to determine the change in weight to measure how much moisture was absorbed by the desiccant in each container. The performance for each of two trials for each container is shown in Table 1 below. The effectiveness was also measured in terms of a Moisture Protection Factor (MPF), is a units-free descriptor of a container's performance in comparison to an established benchmark, in this case a non-airtight state of the art container commercially employed as the current 2 door puck container for Hershey's ICE-BREAKERS mints. An MPF of two would indicate twice the moisture protection, or, mathematically, half of the moisture gained as compared to the benchmark.

TABLE 1

| | Container 1 | | Container 2 | | Container 3 | |
|---|---|---|---|---|---|---|
| Tare wt | 16.86 | 16.85 | 16.90 | 16.89 | 16.82 | 16.82 |
| Initial wt | 46.62 | 44.34 | 41.69 | 52.37 | 41.65 | 40.90 |
| Final wt | 46.63 | 44.35 | 41.71 | 52.38 | 41.66 | 40.91 |
| Weight Δ's | 0.01 | 0.01 | 0.02 | 0.01 | 0.01 | 0.01 |
| % Δ's | 0.0% | 0.0% | 0.0% | 0.0% | 0.0 | 0.0% |
| MPF | 92 | | 62 | | 93 | |

The results show a substantial improvement over the benchmark ranging from 62 to 93 times more moisture resistant and the measurements reflected that the containers were airtight.

Example 2

To test the resistance to ambient air ingress into the containers via the lid door, the three containers used in Example 1 were used in a second example in which the container seal at the top portion/bottom portion interface was glued. The three containers were then weighed to determine a tare weight, filled with dehydrated silica gel desiccants, and weighed again to determine an initial weight.

The lid door was closed and the container was stored at 103° F. and 80% relative humidity for twenty two days. While in that environment, for each of the 22 days during the test the lid doors of the containers were periodically opened and then closed in a manner to simulate a consumer opening the container to access its contents. The containers were weighed again to determine any change in weight to measure how much moisture was absorbed by the desiccants. The performance of the containers is shown in Table 2 below.

TABLE 2

| | Container 1 | Container 2 | Container 3 |
|---|---|---|---|
| Tare wt | 17.10 | 17.15 | 17.17 |
| Initial wt | 40.59 | 40.40 | 39.11 |
| Day 1 | 40.60 | 40.41 | 39.13 |
| Day 6 | 40.66 | 40.43 | 39.16 |
| Day 8 | 40.70 | 40.45 | 39.19 |
| Day 22 | 40.85 | 40.53 | 39.28 |
| Total Weight Δ's | 0.26 | 0.13 | 0.17 |
| Total % Δ's | 1.1% | 0.6% | 0.8% |
| Total Combined % Δ | | 0.8% | |
| Total MPF | | 81 | |

The results show that even with opening and closing the lid door at least once daily in the extreme environment, the average total amount of moisture absorbed was less than 1% of the total desiccant weight.

Example 3

Container top portions having an integral lid door and elliptical opening were constructed in accordance with the embodiment illustrated in FIGS. 13-19. Effectiveness of this lid design was compared with the lid design of the containers used in Example 1 (i.e. having the same airfoil radiusing and recessed opening to promote laminar flow but with the detachable lid and larger, circular opening).

To compare the performance, mason jars were fitted with either one of the two lid designs. The mason jar was weighed, filled with the desiccant, and weighed again to determine an initial desiccant weight. The lid door was closed and the mason jar was stored at 103° F. and 80% relative humidity. For seven weeks the lid doors of the mason jars were periodically opened and the mason jars were weighed again to determine change in weight to calculate how much moisture was absorbed by the desiccants. To provide a direct comparison, a trend line was fit to the data and the moisture absorbed at twenty two days was estimated. As is seen from the performance of the mason jars shown in Tables 4 and 5 below, the opening 607 with the oval shape and the integral lid 130 gained less moisture percent than did the airtight containers 100 with the first top portion 102 and the detachable lid 103.

TABLE 3

| | Mason Jar with Round Opening | | | | |
|---|---|---|---|---|---|
| | Jar 1 | Jar 2 | Jar 3 | Jar 4 | Jar 5 |
| Tare wt | 262.435 | 262.198 | 262.489 | 262.279 | 262.276 |
| Initial wt | 281.310 | 279.520 | 283.582 | 280.797 | 281.218 |
| Day 1 | 281.287 | 279.491 | 283.560 | 280.787 | 281.199 |
| Day 2 | 281.300 | 279.494 | 283.562 | 280.809 | 281.205 |
| 2 weeks | 281.415 | 279.530 | 283.642 | 281.014 | 281.281 |
| 7 weeks | 281.746 | 279.634 | 283.845 | 281.626 | 281.524 |
| Total Weight Δ's | 0.436 | 0.114 | 0.263 | 0.829 | 0.306 |
| Average total % Δ | | | 2.06% | | |
| Estimated % Δ at 22 days | | | 0.95% | | |

TABLE 4

| | Mason Jar with Oval Opening | | | | |
|---|---|---|---|---|---|
| | Jar 1 | Jar 2 | Jar 3 | Jar 4 | Jar 5 |
| Tare wt | 262.626 | 262.417 | 262.485 | 262.897 | 262.644 |
| Initial wt | 283.118 | 280.410 | 279.872 | 281.533 | 278.211 |
| Day 1 | 283.109 | 280.410 | 279.852 | 281.509 | 278.186 |
| Day 2 | 283.114 | 280.432 | 279.863 | 281.515 | 278.193 |
| 2 weeks | 283.158 | 280.653 | 279.909 | 281.558 | 278.236 |
| 7 weeks | 283.296 | 281.341 | 280.052 | 281.703 | 278.338 |
| Total Weight Δ's | 0.178 | 0.931 | 0.180 | 0.170 | 0.127 |
| Average total % Δ | | | 1.76% | | |
| Estimated % Δ at 22 days | | | 0.76% | | |

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and all other patentable subject matter contained herein.

What is claimed is:

1. An airtight container, comprising:

a bottom container portion having a bottom seal section;

a top container portion having a top seal section, the top seal section engaged with the bottom seal section to form a container seal at a circular interface;

an opening in the top container portion, the opening recessed from an outer surface of the top container portion; and a lid door movably secured to the top container portion;

wherein the lid door is configured to selectively engage the opening to form an access seal, and wherein the outer surface of the top container portion is configured with a curvature to promote laminar ambient air flow across the opening when the lid door is disengaged with the opening, thereby reducing an ingress of ambient air into the airtight container while the lid door is disengaged with the opening.

2. The container of claim 1, wherein the container seal is an airtight double-seal.

3. The container of claim 1, wherein the access seal is an airtight seal.

4. The container of claim 1, wherein the access seal is an airtight double seal.

5. The container of claim 1, wherein the outer surface of the top container portion configured to promote laminar ambient air flow contains airfoil radiusing.

6. The container of claim 1, wherein the bottom seal section is permanently secured to the top seal section.

7. The container of claim 1, wherein the opening in the top container portion is circular.

8. The container of claim 7, wherein the opening in the top container portion has a diameter that is greater than half a diameter of the top container portion.

9. The container of claim 1, wherein the opening in the top container portion is elliptical.

10. The container of claim 1, wherein the lid door engages the opening to form the access seal such that an applied force in the range of 3 to 5 pounds per square inch is required to disengage the lid door from the opening.

11. The container of claim 1, wherein the lid door is hingedly attached to the top container portion.

12. The container of claim 1, wherein the lid door is integral the top container portion.

13. The container of claim 1, wherein a mating feature of the lid door is configured to approach the opening in a substantially vertical direction to engage the opening to form the access seal.

14. The container of claim 1, wherein the container has a maximum diameter of 3 inches.

15. An airtight container, comprising:

a bottom container portion having a bottom seal section;

a top container portion having a top seal section, the top seal section engaged with the bottom seal section to form a permanent airtight double container seal at a circular interface;

a circular or elliptical opening in the top container portion, the opening recessed from an outer surface of the top container portion; and a lid door movably secured to the top container portion;

wherein the lid door is configured to selectively engage the opening to form an access seal and further configured to be disengaged from the opening upon a force in the range of 3 to 5 pounds per square inch, wherein the outer surface of the top container portion is configured with airfoil radiusing to promote laminar ambient air flow across the opening when the lid door is disengaged with the opening, thereby reducing an ingress of ambient air into the airtight container while the lid door is disengaged with the opening, and wherein the container has a diameter of five inches or less.

16. The container of claim 15, wherein the access seal is an airtight seal.

17. The container of claim 15, wherein the access seal is an airtight double seal.

18. The container of claim 15, wherein a mating feature of the lid door is configured to approach the opening in a substantially vertical direction to engage the opening to form the access seal.

* * * * *